US006074601A

United States Patent [19]

Nakamura

[11] Patent Number: 6,074,601

[45] Date of Patent: Jun. 13, 2000

[54] QUENCH HARDENING JIG FOR A CYLINDRICAL WORK PIECE

[76] Inventor: Shigeru Nakamura, 3-12, Kashiwa 3-chome, Kashiwa, Chiba, Japan

[21] Appl. No.: 09/095,903

[22] Filed: Jun. 11, 1998

[30] Foreign Application Priority Data

Feb. 3, 1998 [JP] Japan ..... 10-035385

[51] Int. Cl.[7] ..... C21B 3/00

[52] U.S. Cl. ..... 266/274; 432/253

[58] Field of Search ..... 266/274; 432/253, 432/260, 261; 148/646

[56] References Cited

U.S. PATENT DOCUMENTS 723,167 3/1903 Lawrence ..... 266/274

1,530,805 3/1925 Ayers ..... 266/274

*Primary Examiner*—Scott Kastler

*Attorney, Agent, or Firm*—Rogers & Killeen

[57] ABSTRACT

A quench hardening jig for a cylindrical work piece comprises a flat shaped base member(1), a plurality of taper plates(2) and an inversely tapered block(4), the plurality of the taper plates being disposed radiantly on the base member retractably relative to a center of the base member while each taper plate being formed such that it is substantially L shaped in its front view and an internal surface thereof is tapered, the inversely tapered block having an inversely tapered surface(4*a*) fitting to the tapered surface(2*a*) of the taper plate and being mounted on the tapered surface of the taper plate such that a progress of the inversely tapered block(4) in a vertical direction contracts/expands an external diameter formed by the respective taper plates(2).

15 Claims, 4 Drawing Sheets

QUENCH HARDENING JIG FOR A CYLINDRICAL WORK PIECE

BACKGROUND OF THE INVENTION

1. Field of the Invention

This invention relates to a quench hardening jig for a cylindrical work piece.

2. Description of the Prior Art

In conventional quench hardening of a machined cylindrical work piece, when a heated work piece is dipped into an oil bath, deformation occurs in the work piece due to shrinkage. To suppress this deformation to a minimum extent, a jig J1 shown in FIGS. 6, 7 is fit to, for example, an internal diameter of each end of a work piece W1 shown in FIG. 8 when it is dipped into an oil bath.

Because the above jig is formed so as to follow the internal diameter of a particular work piece W1, this jig cannot be used to a work piece having a different internal diameter. Thus, according to this conventional art, there is such an inconvenience that a different jig must be prepared depending on the internal diameter of each work piece.

Further, although the roundness of both ends of a work piece W1 can be realized with the conventional jig, there is a problem that the roundness of an intermediate section thereof is hard to secure. Additionally, because the conventional jig J1 is produced corresponding to the internal diameter of the work piece W1, when this work piece is dipped in an oil bath with the jig, that jig may be tightened by the work piece W1 if it may shrink. In this case, a procedure for removing the jig after dipping takes more time and labor than otherwise. Referring to FIGS. 6–8, reference numeral 10 denotes a ring like base member forming the jig J1 and numeral 11 denotes each of blocks disposed radiantly. A circle connecting an external periphery of each block agrees with an internal diameter of the work piece W1.

SUMMARY OF THE INVENTION

The present invention has been made to solve the above-described problem of the quench hardening jig for a cylindrical work piece. Therefore, an object of the invention is to provide a quench hardening jig for a cylindrical workpiece, which can be used for work pieces having a different size and can be removed easily after quench hardening is completed.

To achieve the above object, the present invention provides a quench hardening jig for a cylindrical work piece comprising a flat shaped base member, a plurality of taper plates and an inversely tapered block, the plurality of the taper plates being disposed radiantly on the base member retractably relative to a center of the base member while each taper plate being formed such that it is substantially L shaped in its front view and an internal surface thereof is tapered, the inversely tapered block having an inversely tapered surface fitting to the tapered surface of the taper plate and being mounted on the tapered surface of the taper plate such that a progress of the inversely tapered block in a vertical direction contracts/expands an external diameter formed by the respective taper plates.

DESCRIPTION OF THE PREFERRED EMBODIMENTS

Figure 1:
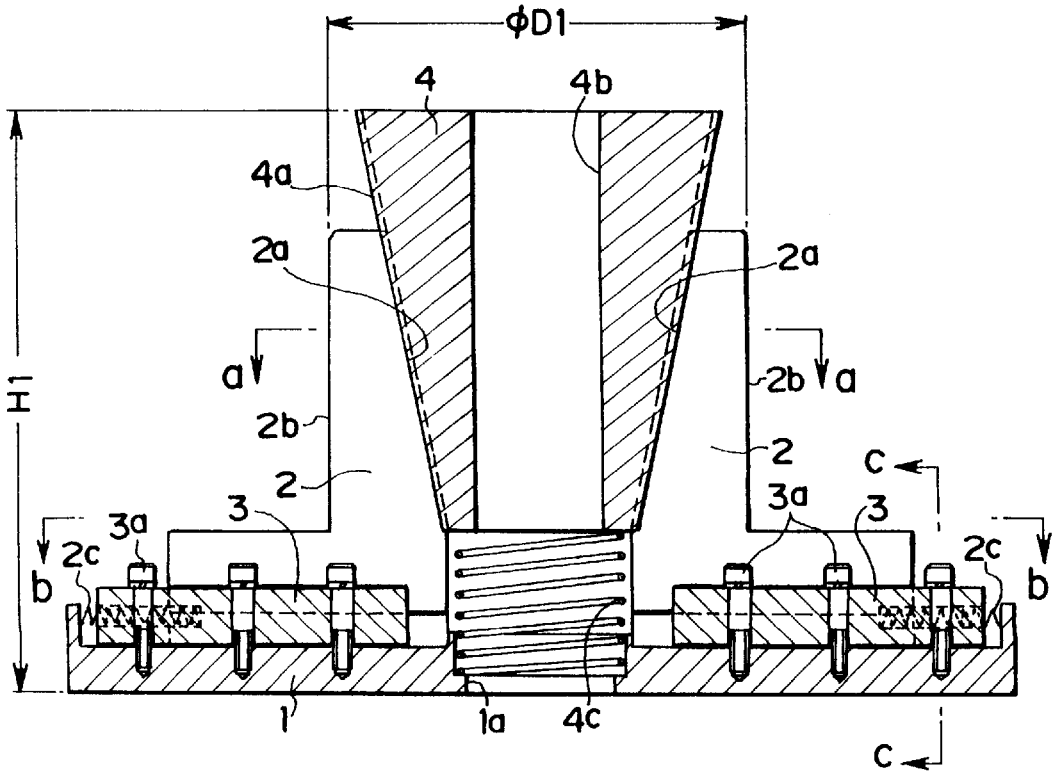
FIG. 1 is a front view of an embodiment of a jig according to the present invention.
Figure 2:
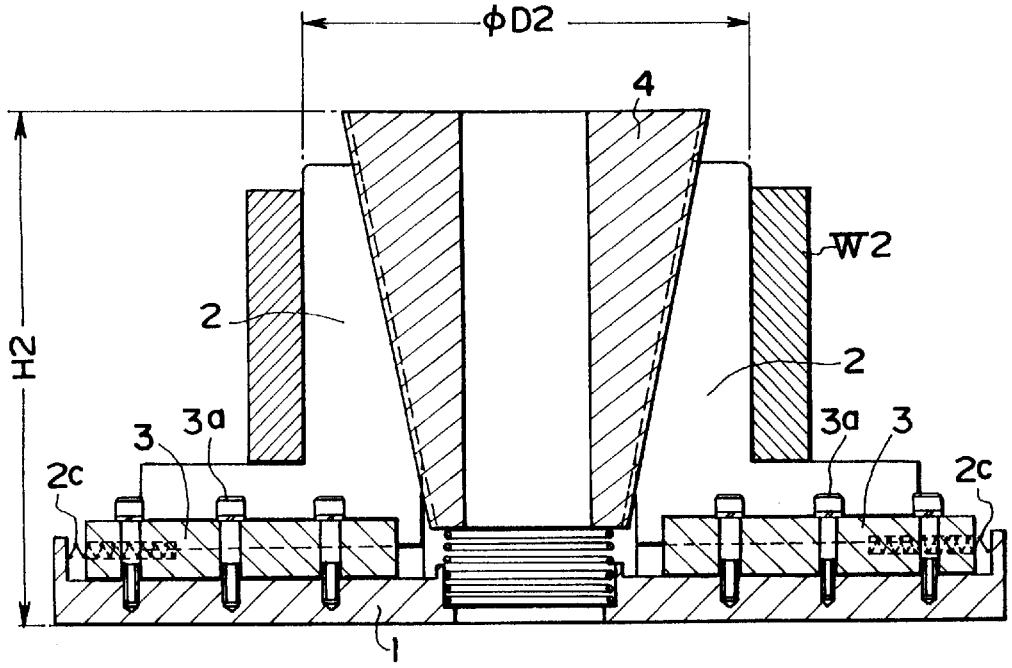
FIG. 2 is a front sectional view of an in-use condition of the jig of FIG. 1.
Figure 3:
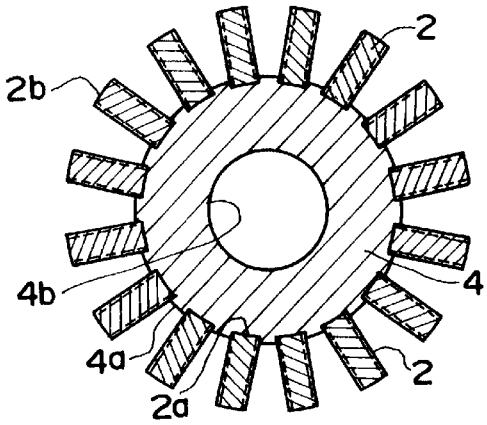
FIG. 3 is a sectional view taken along the line a—a of FIG. 1.
Figure 4:
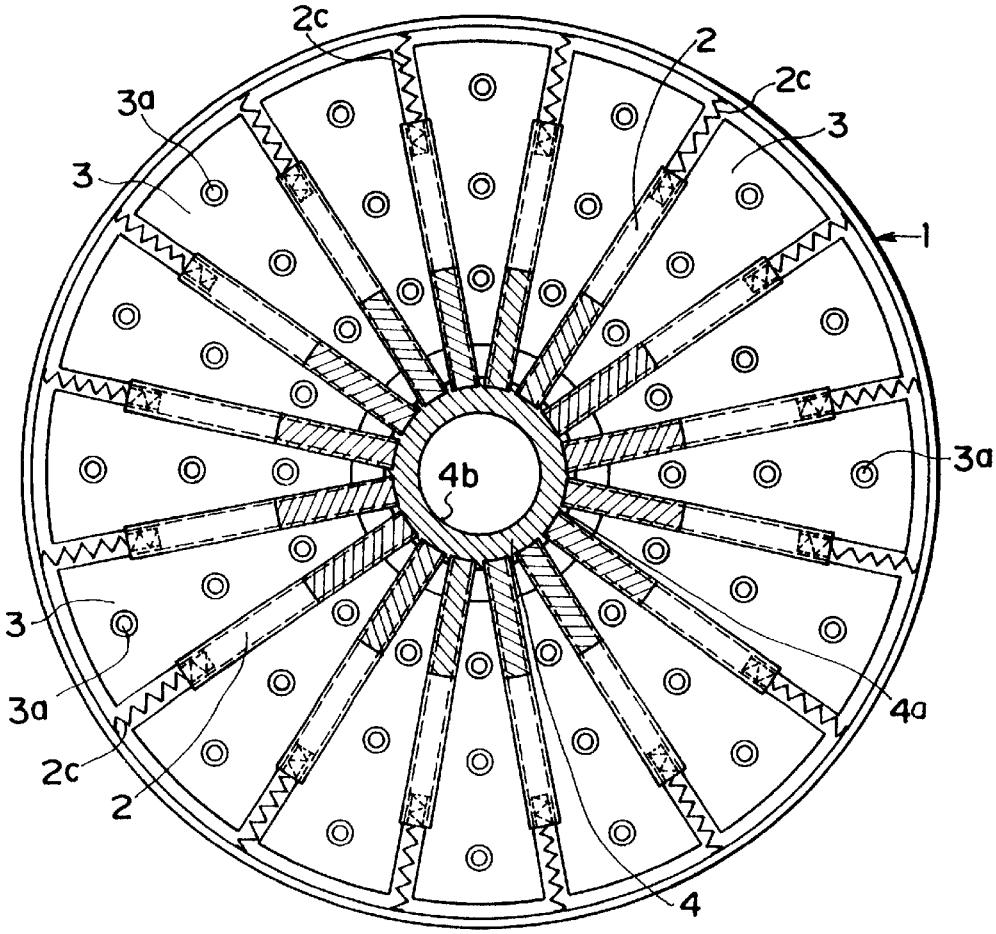
FIG. 4 is a sectional view taken along the line b—b of FIG. 1.
Figure 5:
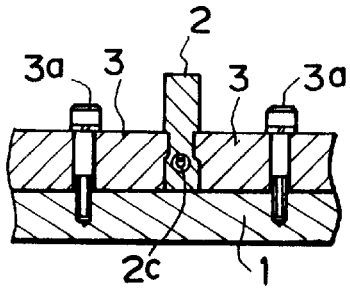
FIG. 5 is a sectional view taken along the line c—c of FIG. 1.
Figure 6:
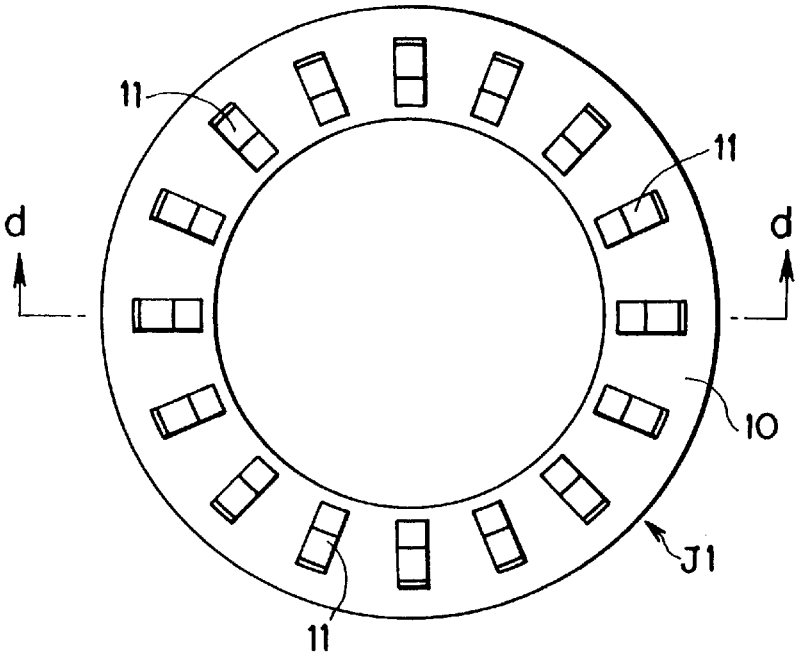
FIG. 6 is a plan view of a conventional jig.
Figure 7:
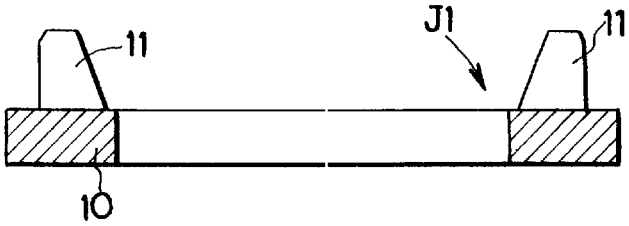
FIG. 7 is a sectional view taken along the line d—d of FIG. 6.
Figure 8:
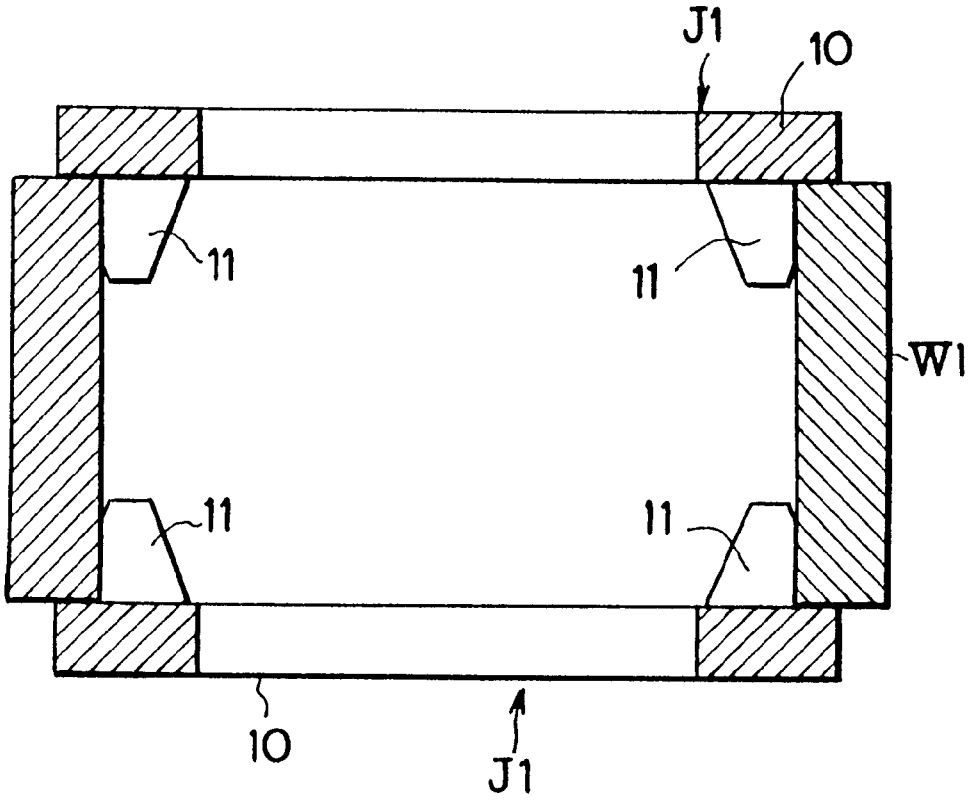
FIG. 8 is a drawing showing a in-use condition of the conventional jig.

Next, the embodiment of the present invention will be described with reference to the accompanying drawings. FIG. 1 is a front view of an embodiment of a jig of the present invention. FIG. 2 is a front sectional view of an in-use state of the jig of FIG. 1. FIG. 3 is a sectional view taken along the line a—a of FIG. 1. FIG. 4 is a sectional view taken along the line b—b. FIG. 5 is a sectional view taken along the line c—c. FIG. 6 is a plan view of a conventional view. FIG. 7 is a sectional view taken along the line d—d and FIG. 8 is a drawing showing an in-use condition of the conventional jig.

Referring to FIGS. 1–5, reference numeral 1 denotes a circular base member having a hole 1*a*. Numeral 2 denotes a taper plate which is a member having a L shape in its front view provided radiantly on the aforementioned base member 1 and the inside face relative to its vertical direction of which has a tapered surface 2*a*. Here, according to an embodiment which will be described below, this taper plate is mounted retractably with respect to a center of the base member 1, on the base member 1. Meanwhile, the hole 1*a* is desired to be as large as possible within its reasonable range so as to secure a smooth flow of fluid for quenching.

Each of the taper plates 2 is provided radiantly on the base plate 1 such that both sides of a root portion thereof are nipped retractably by guide plates 3 thereby forming a radial slot, as shown in FIGS. 4 and 5, for guiding the standing state and retracting action of each taper plate 2. Each taper plate 2 is pressed from its back in a forward direction (toward a center of each base member 1) by a spring 2*c* so that an external diameter øD1 formed by an external surface 2*b* of a vertical member of each plate 2 becomes minimum. A motion of each taper plate 2 toward an external periphery of the base member 1 is free. Reference numeral 3*a* denotes a bolt for fixing each guide plate 3 onto the base member 1.

By advancing the respective taper plates 2 provided on the top of the base member 1 radiantly relative to a center thereof toward the external periphery of the base member 1 by a required amount (distance), a circle formed by the external surfaces 2*b* of the respective taper plates 2 forms a cylinder having a diameter of øD2 thereby making it possible to cope with a work piece of various internal diameters.

According to the present invention, a means for a progress of each taper plate 2 is adjusted by an inversely tapered block 4 the external peripheral surface of which is formed on a tapered surface 4*a* which is oriented in an opposite direction to the aforementioned tapered surface 2*a*. Reference numeral 4*b* denotes a hole made in the center of the inversely tapered block 4 and reference numeral 4*c* denotes a spring inserted between a bottom face of this block 4 and the base member 1, which balances a weight of this inversely tapered block 4. As a result, until a force pressing the inversely tapered block 4 downwardly is applied, the taper plate 2 is kept pressed toward the center thereof by the spring 2*c* so that the minimum diameter øD1 as shown in FIG. 1 is formed. That is, as shown in FIG. 1, when there is no force pressing the inversely tapered block 4 downwardly, namely a height of the inversely tapered block 4 is H1, the taper plate 2 remains pressed toward the center thereof so as to form the minimum diameter øD1.

As for a method for fixing a position of the inversely tapered plate 4 determined relative to a vertical direction, there is a method for nipping between a top end of the block 4 and a bottom face of the base member 1 by, for example, a clamping means (not shown) such as a clamp or a method in which the hole 4*b* located in the center of the inversely tapered block 4 is threaded and a bolt (not shown) capable of fitting to the aforementioned threads is provided from the side of the center hole 1*a* of the base member 1 so that the vertical position of the block 4 is adjusted by an downward extraction amount of the block 4 by a rotation of this bolt and fixed. Further, the method for positioning the block 4 may be other method than mentioned above, such as a method of fixing the block 4 by pressing it by a clamping means such as a press. FIG. 2 shows a case in which it is capable of coping with a work piece W2 having an internal diameter øD2 by adjusting the height of the block 4 to H2.

The jig of this invention in which the external surface 2*b* of each taper plate 2 is adjusted to meet the internal diameter of the work piece W2 is actually used under a condition shown in FIG. 2. If a work piece W2 shrinks after quenched, the work tightens each taper plate 2 inwardly so as to produce a force pushing the inversely tapered block 4 upward. If the clamping means is loosened, the tightening of the work piece W2 is released quickly so that the removal of the jig is very easy.

What is claimed is:

1. A quench hardening jig for a cylindrical workpiece comprising a flat shaped base member, a plurality of taper plates and an inversely tapered block, the plurality of the taper plates being disposed radiantly on the base member retractably relative to a center of said base member while each taper plate being formed such that it is substantially L shaped in its front view and an internal surface thereof is tapered, the inversely tapered block having an inversely tapered surface fitting to the tapered surface of the taper plate and being mounted on said tapered surface of the taper plate such that a progress of the inversely tapered block in a vertical direction contracts/expands an external diameter formed by the respective taper plates, each of said taper plates being slidably disposed in radial slots formed in said base member.

2. The quench hardening jig of claim 1, wherein said base member includes a flat axially facing surface and a plurality of pie shaped guide plates carried by said surface, said guide plates being spaced apart thereby forming said radial slots.

3. A quench hardening jig for a workpiece having a cylindrical opening comprising:

a plurality of slidable L-shaped plates, each of said plates including an axial leg adapted to extend axially inside of the cylindrical opening, said axial leg having inner and outer edges and being tapered along said inner edge so that the distal end of said axial leg is the narrower end, and a radial leg having a bottom and top edge and being adapted to extend radially away from the axis of the cylindrical opening when positioned under the workpiece; and a cone shaped block centrally disposed adjacent said L-shaped plates, the exterior surface of said block being tapered inversely to said axial leg of each of said L-shaped plates thereby providing a cooperative boundary, said L-shaped plates and said cone being positioned so that said plates slide radially outward to establish substantially linear contact with the workpiece along said outer edge of each of said axial legs when said block moves downwardly, thereby reducing the contact between the workpiece and facilitating removal of the jig upon the completion of a quench hardening process.

4. The jig of claim 3, further comprising a spring disposed under said block for biasing said tapered block upwards with respect to the radial legs of said L-shaped plates.

5. The jig of claim 3, further comprising a plurality of guide plates located adjacent the bottom of each of said radial legs in a spaced part arrangement thereby forming a radial slot between each pair of said guide plates, the radial leg each of said L-shaped plates being slidable in one of said radial slots.

6. A quench hardening jig for a workpiece having a cylindrical opening comprising:

a plurality of slidable L-shaped plates each plate including a tapered axial leg adapted to be positioned inside of the cylindrical opening and having an inner edge angled so that the width of the axial leg is smallest at the distal end, and a radial leg adapted to be positioned under the workpiece;

a cone shaped block centrally disposed adjacent said L-shaped plates, the exterior surface of said block being tapered inversely to the axial leg of each of said L-shaped plates thereby providing a cooperative boundary, so that said plates slide radially outward along said radial legs to contact the workpiece when said block moves downwardly; and a spring disposed under said block for biasing said block upwardly relative to the radial legs thereby facilitating separation of the jig and the workpiece after completion of a quench hardening process.

7. The jig of claim 6, wherein each of said axial legs comprises an outer edge surface substantially orthogonal to the two L-shaped plate surfaces of the respective L-shaped plate so that substantially linear contact occurs between the workpiece and the outer edge surface of each of said L-shaped plates.

8. The jig of claim 6, further comprising a plurality of pie shaped guide plates, said guide plates being spaced apart thereby forming a radial slot between each pair of guide plates with the number of slots corresponding to the number of L-shaped plates, said radial leg of each of L-shaped plates being slidable in one of said radial slots.

9. The jig of claim 8, wherein said guide plates overlie, and are secured to, a base member.

10. In a quench hardening jig for a workpiece having a cylindrical opening, said jig adapted to be positioned inside the cylindrical opening and including a plurality of tapered members and a wedge tapered inversely to each of said members, movement of said wedge along the axis of the opening in the direction of the smaller end of the wedge causing said tapered members to slide outwardly into supporting contact with the workpiece, the improvement comprising a spring for biasing said wedge in the direction of the larger end of the wedge thereby facilitating removal of the workpiece from the jig upon completion of a hardening process.

11. The jig of claim 10, wherein said spring biases said tapered members toward said wedge.

12. The jig of claim 10, wherein said spring is disposed adjacent the smaller end of said wedge.

13. The jig of claim 12, wherein said jig includes a plurality of second springs, each of said second springs biasing one of said tapered members toward said wedge.

14. A quench hardening jig to be placed in a cylindrical opening of a workpiece to be hardened by submersion in a quenching liquid, said jig including a plurality of slidable supporting plates distributed radially about the axis of the opening and oriented so that the plate surfaces of each of said supporting plates are substantially parallel to the axis of the cylindrical opening, each of said plates being tapered along the interior edge thereby matching a core block tapered inversely, said core capable of being forced downwardly against said plates thereby sliding said plates radially outward into contact with the workpiece, the outer edge of each of said plates being a substantially flat surface so that substantially linear contact occurs between each of the plates and the workpiece thereby increasing contact between the workpiece and the quenching liquid during a quench hardening process.

15. A quench hardening jig to be placed in a cylindrical opening of a workpiece to be hardened by submersion in a quenching liquid, said jig including a plurality of sliding supporting plates each of said plates being tapered along the interior edge to match an inversely tapered cone capable of downward movement against said plates to thereby slide said plates outwardly into contact the workpiece, the plates being distributed radially about the axis of the opening so that the area of contact between the workpiece and the plates is less than half of the surface area of the workpiece in the cylindrical opening thereby increasing contact between the workpiece and the quenching liquid.

* * * * *